US005156733A

United States Patent [19]

Nongbri et al.

[11] Patent Number: 5,156,733

[45] Date of Patent: * Oct. 20, 1992

[54] METHOD FOR CONTROLLING SEDIMENTATION IN AN EBULATED BED PROCESS

[75] Inventors: Govanon Nongbri, Port Neches; Gerald V. Nelson, Nederland; Stanley M. Farabee, Beaumont, all of Tex.

[73] Assignee: Texaco Inc., White Plains, N.Y.

[ * ] Notice: The portion of the term of this patent subsequent to Feb. 6, 2007 has been disclaimed.

[21] Appl. No.: 749,087

[22] Filed: Aug. 23, 1991

Related U.S. Application Data

[63] Continuation-in-part of Ser. No. 329,925, Mar. 29, 1989, abandoned.

[51] Int. Cl.[5] ..... C10G 45/20

[52] U.S. Cl. ..... 208/108; 208/157; 208/DIG. 1

[58] Field of Search ..... 208/108, 157, 162, DIG. 1

[56] References Cited

U.S. PATENT DOCUMENTS 4,053,390 10/1977 James ..... 208/108

4,898,663 2/1990 Sayles et al. ..... 208/108

*Primary Examiner*—Anthony McFarlane

*Attorney, Agent, or Firm*—Jack H. Park; Kenneth B. Priem; Richard A. Morgan

[57] ABSTRACT

In an ebullated bed process, it has been found that in switching from one sediment yielding feedstock to a second sediment yielding feedstock that the transient sediment concentration has caused unit shutdowns with lost production. A method has been found which avoids these high transient sediment concentrations. Fresh addition is substituted for regenerated catalyst addition until the average carbon on catalyst in the bed drops to 22 wt% basis carbon free catalyst. Second feedstock is added incrementally and sediment in the product analyzed. After full second feedstock rate is achieved, first feedstock is reduced incrementally with sediment analysis. Higher unit utilization is achieved with the corresponding increased yearly production.

8 Claims, 2 Drawing Sheets

METHOD FOR CONTROLLING SEDIMENTATION IN AN EBULATED BED PROCESS

CROSS-REFERENCE TO RELATED APPLICATION

This application is a continuation-in-part of application Ser. No. 07/329,925 filed Mar. 29, 1989, now abandoned for a Method For Controlling Sedimentation In An Ebullated Bed Process.

BACKGROUND OF THE INVENTION

1. Field of the Invention

The invention relates to a method in an ebullated bed process for changing feedstock from a sediment yielding feedstock to a different sediment yielding feedstock.

2. Description of Other Relevant Methods in the Field

The ebullated bed process comprises the passing of concurrently flowing streams of liquids, or slurries of liquids and solids, and gas through a vertically cylindrical vessel containing catalyst. The catalyst is placed in random motion in the liquid and has a gross volume dispersed through the liquid greater than the volume of the mass when stationary. The ebullated bed process has found commercial application in the upgrading of heavy liquid hydrocarbons and converting coal to synthetic oils.

The process is generally described in U.S. Pat. Re No. 25,770 to Johanson incorporated herein by reference. A mixture of hydrocarbon liquid and hydrogen is passed upwardly through a bed of catalyst particles at a rate such that the particles are forced into random motion as the liquid and gas pass upwardly through the bed. The catalyst bed motion is controlled by a recycle liquid flow so that at steady state, the bulk of the catalyst does not rise above a definable level in the reactor. Vapors along with the liquid which is being hydrogenated pass through that upper level of catalyst particles into a substantially catalyst free zone and are removed from the upper portion of the reactor.

Reactors employed in a catalytic hydrogenation process with an ebullated bed of catalyst particles are designed with a central vertical recycle conduit which serves as the downcomer for recycling liquid from the catalyst free zone above the ebullated catalyst bed to the suction of a recycle pump to recirculate the liquid through the catalytic reaction zone. The recycling of liquid from the upper portion of the reactor serves to ebullate the catalyst bed, maintain temperature uniformity through the reactor and stabilize the catalyst bed.

U.S. Pat. No. 4,053,390 to L. C. James teaches a start-up procedure for an ebullated bed process. In the procedure, a light oil is used to establish an ebullating bed. A heavy residual oil feedstock is incrementally substituted for the light oil. Hydrogen gas flow rate and ebullating pump speed are set to maintain ebullated bed expansion. In the incrementally changing feed stream, viscosity is controlled within $\pm 10\%$ and specific gravity controlled within $\pm 5\%$ to maintain a constant expansion of the ebullated bed, at a constant ebullating pump rate and gas flow rate.

U.S. Pat. No. 3,809,644 to A. R. Johnson et al. teaches a multiple stage ebullated bed hydrodesulfurization process. In the process catalyst is poisoned by the deposition of 100 to 700 ppm metals, principally nickel and vanadium from the vacuum resid feedstock. In the process used catalyst is passed sequentially from down stream reactors to upstream reactors thereby extending the economic life of the catalyst.

SUMMARY OF THE INVENTION

The invention is a method for changing feedstock in an ebullated bed process from a first feedstock to a second feedstock of different sediment yield.

The ebullated bed process is a continuous process for treating a fluid hydrocarbon feedstock with a hydrogen-containing gas at elevated catalytic reaction temperatures in the presence of a particulate solid catalyst. In the process, the hydrogen-containing gas and feedstock are introduced into the lower end of a vertical reaction vessel wherein the catalyst is placed in random motion within the fluid hydrocarbon and the catalyst bed is expanded to a volume greater than its static volume. The mixture of feedstock, gas and catalyst comprises a turbulent zone from which aged, carbon containing catalyst is removed and fresh, low carbon catalyst is added. The upper portion of the turbulent zone is defined by a substantially catalyst depleted zone from which hydrocracked product is removed.

In the improved method, the introduction of fresh carbon free catalyst is suspended and replaced with regenerated, carbon reduced catalyst to reduce the carbon on catalyst in the bed to 22 wt % or less. Then, the flow rate of the first feedstock (F1) is set at a first flow rate F1(1). Flow of second feedstock (F2) is then initiated at an initial flow rate (F2(1)) not more than 5 vol % of the sum of F1(1) and F2(1). This causes a transient increase in the sediment concentration in the hydrocracked product, followed by a decrease. Flow rate F2(1) is maintained until the decrease reaches a preselected, tolerable sediment concentration in the hydrocracked liquid product (P). The flow rate of second feedstock F2 is increased in increments. In the interim between each increment a similar transient increase in sediment concentration followed by decrease to the selected concentration occurs. Finally, the desired steady state flow rate (F2(SS)) of second feedstock (F2) is achieved.

The flow rate of first feedstock (F1) is reduced incrementally, to the same sediment in cracked product limitation until the desired flow rate of first feedstock (F1) is reached. If required flow of first feedstock (F1) may be terminated.

High transient sediment concentration with associated downstream equipment plugging is avoided.

BRIEF DESCRIPTION OF THE DRAWINGS

The FIG. 1 is a schematic representation of a method for switching from a sediment yielding feedstock to a feedstock of different sediment yield in an ebullated bed process.

DETAILED DESCRIPTION OF THE DRAWINGS

Figure 1:
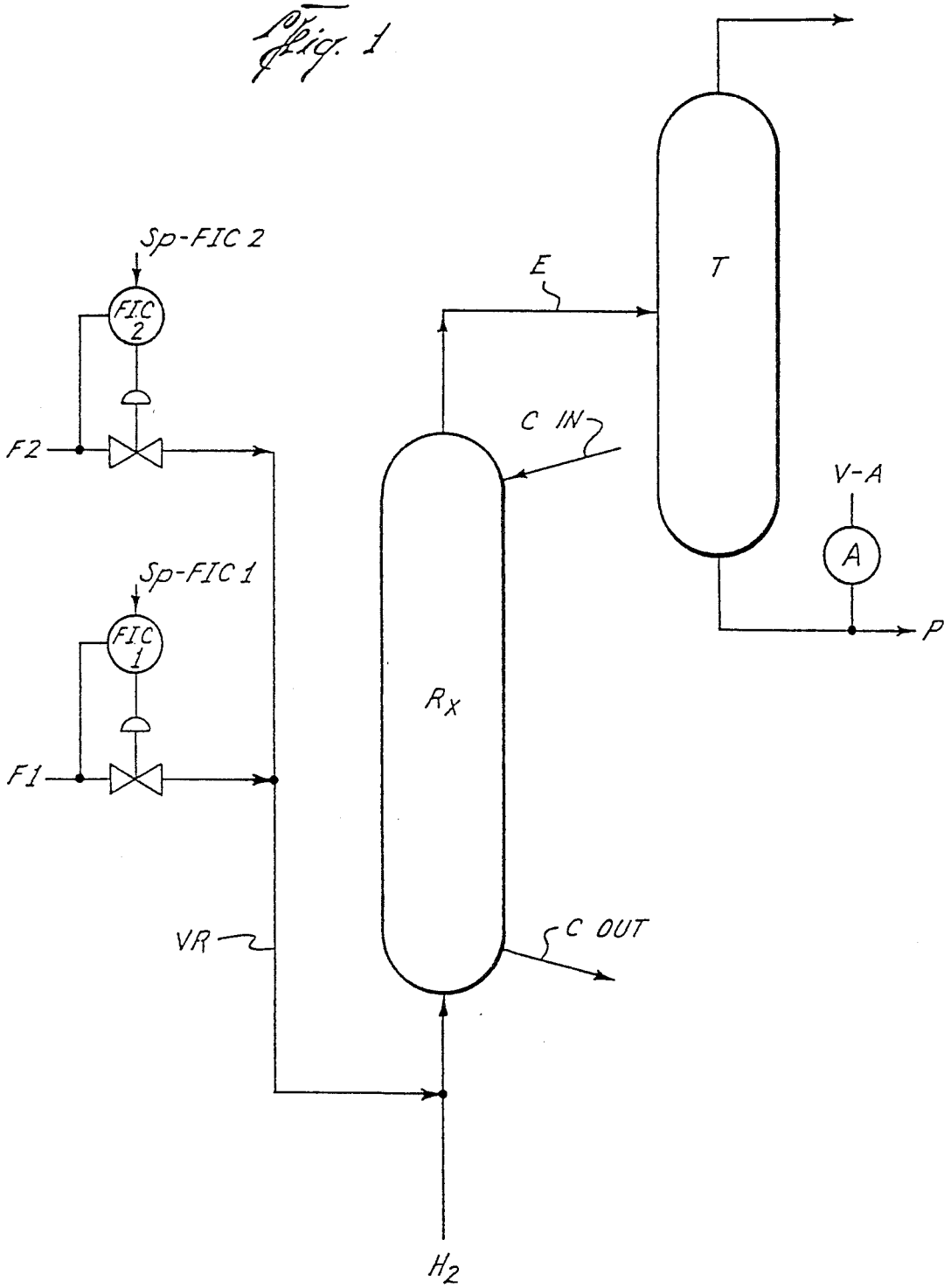

A first feedstock (F1) such as a vacuum residuum fraction from a Saudi Arabian crude produces low amounts of sediment when passed along with a hydrogen-containing gas ($H_2$) upwardly through an ebullated bed of catalyst (Rx) in a hydrocracking zone at a temperature of 650° F. to 950° F. and hydrogen partial pressure in the range of 1000 psia to 5000 psia.

In order to maintain catalytic activity, an amount of carbon deactivated catalyst is withdrawn from the bed via duct C out. An equivalent amount of catalyst reduced in carbon is added via duct C in. This added catalyst may be regenerated, used catalyst reduced in carbon or fresh, carbon free catalyst. Ebullated bed effluent (E) is fractionated in a fractionation train (T) to yield a liquid bottom product (P). Sediment analyzer (A) produces a value (V-A) corresponding to the concentration of sediment in the liquid product (P) indicating that first feedstock (Fl) is yielding a low sediment concentration, e.g. below the threshold of analysis.

A second feedstock (F2) such as a vacuum residuum fraction derived from a Maya crude is known to produce large amounts of sediment when processed in an ebullated bed (Rx). In particular, the largest amounts of sediment are produced during feedstock switching. The total amount of sediment produced is not susceptible to control by this method. However, the sediment concentration can be controlled to prevent high transient sediment concentrations which have plugged downstream equipment during feedstock switching.

In switching from the first feedstock (F1) to the second feedstock (F2), the flow rate of the first feedstock (F1) is set at a first flow rate F1(1) on first flow rate indicator and controller (FIC 1) Flow of second feedstock (F2) is then initiated on second flow indicator and controller (FIC 2) in the amount of F2(1), an increment which may be 0.1 vol % to a maximum of 5 vol%, preferably 1 vol % to 2 vol % of the final flow rate. Total flow to the reactor Rx is then a mixture of vacuum resid (VR) from first feedstock (F1) and second feedstock (F2).

The concentration of sediment which can be tolerated in the product (P) without causing downstream plugging is known from previous experience.

With the hydrocracking of second feedstock (F2), an amount of sediment is detected in liquid product stream (P) as measured by the analyzer (A). The Analyzer (A) indicates a value (V-A) which is representative of this amount of sediment. A setpoint (Sp-FIC 2) for second flow rate indicator and controller (FIC 2) based on the difference between allowable sediment concentration and actual sediment concentration (V-A) is determined based on experience. The setpoint (Sp-FIC 2) of second flow indicator and controller (FIC 2) is reset to a second flow rate (F2(2)) at which a preselected tolerable concentration of sediment in product (P) is reached. Finally, the desired final flow rate of second feedstock (F2) is reached (F2(SS)) at which actual sediment value (V-A) is less than or equal to the allowable. Of course, should actual sediment concentration (V-A) exceed the allowable limit, the setpoint (Sp-FIC 2) is reset incrementally downward until the transient passes, after which the second feed rate (F2) is incrementally stepped up once again.

It is characteristic of the dynamics of the ebullated bed process that the sediment value (V-A) in product (P) will drop off after a period of second feedstock (F2) steady state flow (F2(SS)). When this drop off is noticed, the flow rate of first feedstock (F1) is incrementally reduced by means of first flow indicator and controller (FIC 1). The flow may finally be reduced to a desired rate or shut off.

It is characteristic of the system that these transients occur when switching from a low to a high sediment yielding feedstock or from a high to a low sediment yielding feedstock. Accordingly, the method is applied whenever a switch in feedstocks is made wherein the feedstocks have a significant difference in their sediment yield.

DETAILED DESCRIPTION OF THE INVENTION

High transient carbon release from catalyst is known to occur in high pressure resid upgrading processes. In an ebullated bed process, carbon dissociates from the catalyst and leaves the reactor with the liquid product, settling in downstream equipment. For example in a feedstock change, vacuum resid derived from Maya crude, added to a feedstock in an amount of 12 to 15% caused about 30,000 lb. to 37,000 lb. of carbon to slough off 538,460 lb. of catalyst held in four reactors. Carbon deposition in downstream equipment plugged pipes and caused a shutdown of the ebullated bed unit.

An improved method has been discovered for switching feedstocks in an ebullated bed process which overcomes high transient carbon release and associated equipment fouling. The method relies on preconditioning the catalyst bed for the feedstock switch by reducing the carbon on catalyst to 22 wt % or less. This reduced carbon loading makes less carbon available to slough off the catalyst.

Two methods have proven effective to accomplish this carbon reduction. The first relies on an anomaly in catalyst carbon retention. Fresh, low age catalyst accumulates more carbon than used, aged catalyst. Therefore during transient carbon release such as during a feedstock switch, fresh catalyst sloughs more carbon than aged catalyst because there is more carbon available on the fresh catalyst.

In the ebullated bed process, spent carbon containing catalyst is removed periodically from the reactor and an equivalent amount of catalyst reduced in carbon added to maintain catalyst bed activity. Added catalyst may be fresh, carbon free catalyst; regenerated, aged catalyst substantially reduced in carbon or a mixture of the two.

Applicants have found empirically that by suspending the addition of fresh, carbon free catalyst and adding only regenerated, low carbon catalyst that the carbon on catalyst in the bed can be reduced to 22 wt % or less basis fresh catalyst (weight carbon/weight carbon free catalyst).

At 22 wt %, there is less carbon to slough during a feedstock switch. The reduction in ebullated bed carbon concentration and control of the rate of change in feedstock rate determines the rate of release of carbon from the catalyst bed. Reduced downstream plugging has been achieved.

Reduction in ebullated bed carbon concentration can also be achieved by reducing the conversion of feedstock to hydrocracked product. At higher conversions the catalytic reaction produces relatively more carbon. At lower conversion, less carbon is produced. Accordingly, temperature, pressure and feedstock throughput are adjusted to reduce conversion to a carbon yield in accordance with the required parameters of the invention.

EXAMPLE 1

In a bench unit, sediment content of the hydrocracked product was analyzed by Institute de Petrole Standard Method IP 375/86 to measure release of carbon from catalyst. The effectiveness of the method for this purpose was confirmed by daily catalyst sampling in the commercial unit of Example 2.

Figure 2:
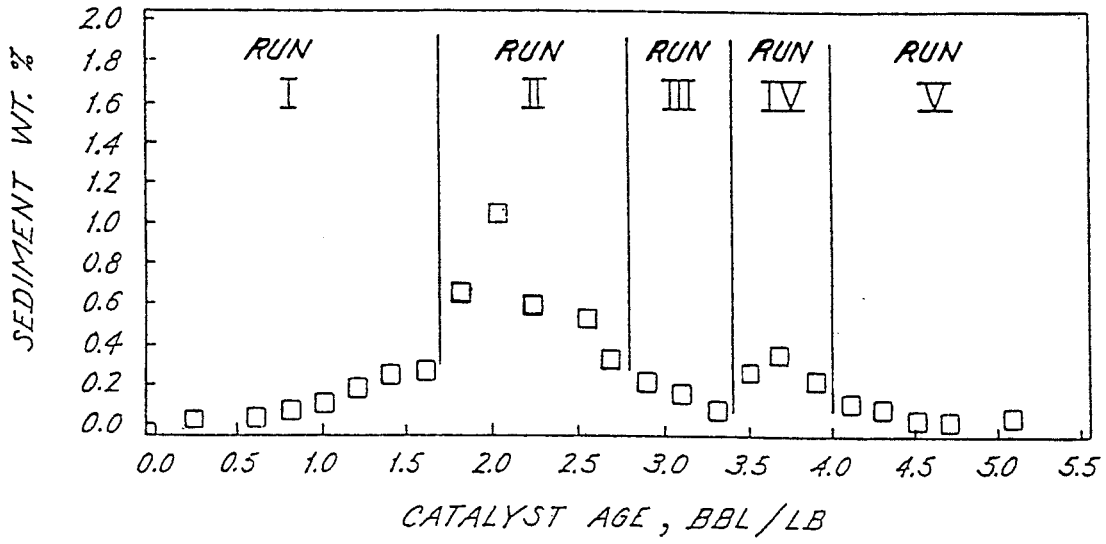
FIGS. 2 and 3 are graphical presentations of data discussed in the Example.

The results of a bench unit test run with a 100% Arab Medium-Heavy crude derived vacuum resid feedstock are shown in FIG. 2 as Run I. Feedstock was switched in Run II to a blend of 18 vol % Maya vacuum resid and 82 vol % Arab Medium-Heavy vacuum resid. Maya vacuum resid is a high sediment producing feedstock. After 16 days of the blend, the feed was switched back to 100% Arab Medium-Heavy resid, Run III. After 9 days on the Arab Medium-Heavy resid, the feed was switched to a blend of 50 vol % Maya and 50 vol % Arab Medium-Heavy resid Run IV. This feedstock was continued for 9 days and then the feed switched back to 100% Arab Medium-Heavy resid, Run V. Properties of the feedstocks and operating conditions are summarized in Tables I and II. The results in FIG. 2 show that upon introduction of the feed containing Maya resid, the rate of carbon release first increased and then dropped off until the catalyst attained a new equilibrium. At the new equilibrium, increase in the amount of Maya resid in the feed blend yielded only minor increases in carbon release.

Figure 3:
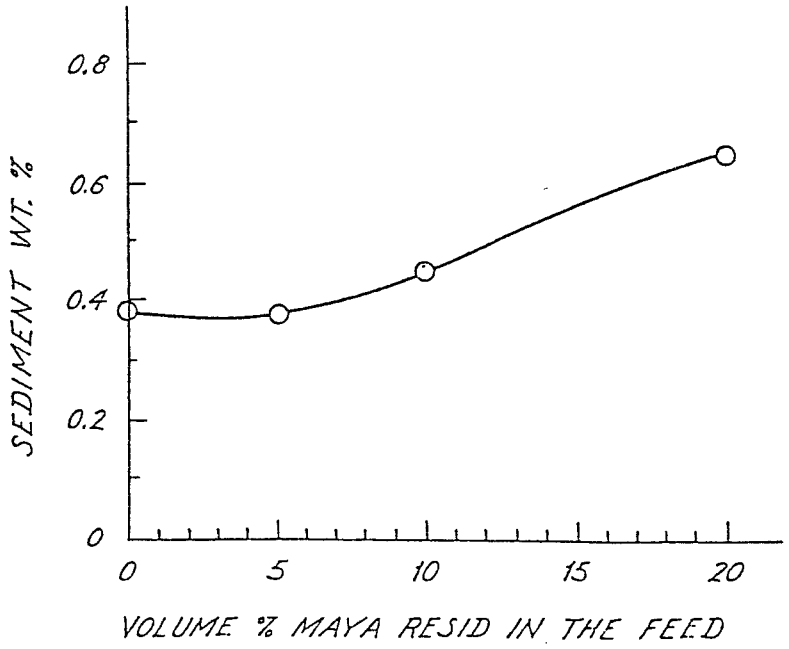

In another bench unit test run, feedstock blends of 5 vol %, 10 vol % and 20 vol % Maya resid with Arab Medium-Heavy vacuum resid were tested. Properties of the feedstocks and operating conditions are summarized in Tables III and IV. As in the previous run, sediment content of the heavy product was analyzed daily. The results from this run are summarized in FIG. 3. The results from this test run show that carbon sloughing increased when the amount of Maya in the blend exceeded 10%. There was no indication of excess carbon release below 5% Maya resid in the blend.

EXAMPLE 2

A commercial ebullated bed unit comprised two ebullated beds in series. A trial run conducted in the unit with up to about 5 vol % Oriente vacuum resid in the feed showed no increased fouling in downstream equipment. Oriente vacuum resid is known to produce large amounts of sediment. The properties of the feed and operating conditions are summarized in Tables V and VI.

The results from the bench unit run indicated that below 6% Maya in the feed, the rate of excess carbon release from the catalyst was negligible. Results also indicated that once the catalyst reached a new equilibrium, a gradual increase in the amount of new feed in the blend does not cause a high transient carbon release. This was demonstrated in the commercial unit as reported in Tables VII and VIII. The unit was started up with up to 4% Maya resid in the feed and the Maya resid increased to 10% in the feed with no indication of accelerated fouling in downstream equipment. Based on pilot unit results, the amount of Maya resid in the feed could have been raised to at least 50% without downstream plugging, once the catalyst was conditioned at a lower concentration of Mayan resid.

Also effective in the reduction of transient carbon release is the substitution of regenerated catalyst for new replacement catalyst. Regenerated used catalyst contains amounts of vanadium as shown in Table IX. It was found experimentally that regenerated, used catalyst with 6.1% vanadium accumulated about 28 wt % carbon when first introduced into the bench unit. New catalyst initially accumulated about 40 wt % carbon.

It has been found that the amount of carbon on the catalyst decreases as the vanadium content of the catalyst increases. Other contaminant metals such as nickel, iron, chromium increase with vanadium.

TABLE I

VACUUM RESID FEEDSTOCK PROPERTIES

| FEED: | AMH | 18/82% Maya/AMH | 50/50% Maya/AMH |
|---|---|---|---|
| Gravity, API | 4.8° | 5.0° | 5.3° |
| Sulfur, wt % | 5.0 | 5.0 | 5.0 |
| Nitrogen, wppm | 4480 | 4770 | 5290 |
| Nickel, wppm | 49 | 61 | 80 |
| Vanadium, wppm | 166 | 208 | 388 |
| Microcarbon Residue | 22.0 | 22.2 | 22.0 |
| 1000° F.+, vol % | 87.5 | 84.6 | 81.1 |

TABLE II

OPERATING CONDITIONS

| FEED: | AMH | 18/82% Maya/AMH | 50/50% Maya/AMH |
|---|---|---|---|
| Inlet Hydrogen Pressure, psia | 2265 | 2265 | 2265 |
| LHSV, v/hr/v | 0.28 | 0.28 | 20.27 |
| Temperature, °F. | 793° | 793° | 793° |
| No of stages | 1 | 1 | 1 |
| 1000° F.+ Conversion, vol % | 65 | 65 | 65 |

TABLE III

VACUUM RESID FEEDSTOCK PROPERTIES

| FEED: | 54/5/34/7% ANS/AM/AH/BL | 5/95% Maya/AMH | 10/90% Maya/AMH | 20/80% Maya/AMH |
|---|---|---|---|---|
| Gravity, API | 4.8° | 4.8° | 4.9° | 5.0° |
| Sulfur, wt % | 5.0 | 5.0 | 5.0 | 5.0 |
| Nitrogen, wppm | 4480 | 4560 | 4640 | 4803 |
| Nickel, wppm | 49 | 52 | 56 | 62 |
| Vandium, wppm | 166 | 155 | 175 | 217 |
| Microcarbon Residue | 22.0 | 22.2 | 22.2 | 22.2 |
| 1000° F.+, vol % | 87.5 | 86.8 | 86.2 | 84.9 |

TABLE IV

SUMMARY OF OPERATING CONDITIONS

| FEED: | 54/5/34/7% ANS/AM/AH/BL | 5/95% Maya/AMH | 10/90% Maya/AMH | 20/80% Maya/AMH |
|---|---|---|---|---|
| Inlet Hydrogen Pressure, psia | 2265 | 2265 | 2265 | 2265 |
| LHSV, v/hr/v | 0.27 | 0.27 | 0.27 | 0.28 |
| Temperature, °F. | 793° | 793° | 793° | 793° |

TABLE IV-continued

| SUMMARY OF OPERATING CONDITIONS | | | | |
|---|---|---|---|---|
| FEED: | 54/5/34/7% ANS/AM/AH/BL | 5/95% Maya/AMH | 10/90% Maya/AMH | 20/80% Maya/AMH |
| No. of stages | 1 | 1 | 1 | 1 |
| 1000° F.+ Conversion, vol % | 66 | 66 | 64 | 63 |

TABLE V

| VACUUM RESID FEEDSTOCK PROPERTIES | |
|---|---|
| FEED: | 57/36/5/2% ALH/ANS/Oriente/EU |
| Gravity, API | 5.1° |
| Sulfur, wt % | 4.2 |
| Nitrogen, wppm | 5000 |
| Nickel, wppm | 45 |
| Vanadium, wppm | 133 |
| Microcarbon Residue, wt % | 22.3 |
| 1000° F.+, Vol % | 93.0 |

TABLE VI

| OPERATING CONDITIONS | |
|---|---|
| FEED: | 57/36/5/2% ALH/ANS/Oriente/EU |
| Inlet Hydrogen Pressure, psia | 2350 |
| LHSV, v/hr/v | 0.37 |
| Temperature, °F. | 808 |
| No of stages | 2 |
| 1000° F.+ Conversion, vol % | 58 |

TABLE VII

| VACUUM RESID FEEDSTOCK PROPERTIES | | |
|---|---|---|
| FEED: | 4/56/31/9% Maya/AH/ANS/Misc | 10/51/34/5% Maya/AH/ANS/Misc |
| Gravity, API | 3.8° | 3.8° |
| Sulfur, wt % | 3.9 | 4.3 |
| Nitrogen, wppm | 4000 | 4500 |
| Nickel, wppm | 46 | 49 |
| Vanadium, wppm | 138 | 160 |
| Microcarbon Residue | 22.2 | 21.5 |
| 1000° F.+, vol % | 88.0 | 85.0 |

TABLE VIII

| OPERATING CONDITIONS | | |
|---|---|---|
| FEED: | 4/56/31/9% Maya/AH/ANS/Misc Vacuum Resid | 10/51/34/5% Maya/AH/ANS/Misc Vacuum Resid |
| Inlet Hydrogen Pressure, psia | 2330 | 2350 |
| LHSV, v/hr/v | 0.39 | 0.40 |
| Temperature, °F. | 808 | 810 |
| No of stages | 2 | 2 |
| 1000° F.+ Conversion, vol % | 58 | 56 |

TABLE IX

| REGENERATED SECOND STAGE CATALYST (Calculated) | |
|---|---|
| Carbon, wt % | 1.1 |
| Sulfur, wt % | 1.5 |
| Hydrogen, wt % | 0.04 |
| Nitrogen, wt % | 0.2 |
| Nickel, wt % | 4.61 |
| Vanadium, wt % | 6.12 |
| Other, wt % | 86.43 |

Definitions

Vacuum Resid Sources

EU—Eugene Island
BL—Bonny Light (Nigerian)
AH—Saudi Arabia Heavy
ALH—Saudi Arabian Light—Heavy
AMH—Saudi Arabian Medium—Heavy
ANS—Alaska North Slope
Misc.—Miscellaneous Crudes
LHSV—Liquid hourly space velocity, vol feed/hr/vol reactor Microcarbon residue ASTM-D4530-85

While particular embodiments of the invention have been described, it will be understood, of course, that the invention is not limited thereto since many modifications may be made, and it is, therefore, contemplated to cover by the appended claims any such modifications as fall within the true spirit and scope of the invention. The inventive method is applicable to any two feedstocks which demonstrate different sediment yielding characteristics.

What is claimed is:

1. In a process for changing feedstock from a first, sediment yielding feedstock to a second feedstock of different sediment yield in a continuous process for treating a fluid hydrocarbon feedstock with a hydrogen-containing gas at elevated catalytic reaction temperature and pressure in the presence of a bed of particulate solid catalyst, said catalyst comprising an amount of carbon thereon, said process comprising introducing the hydrogen-containing gas and feedstock into the lower end of a generally vertical catalyst containing reaction vessel wherein the catalyst is placed in random motion within the fluid hydrocarbon whereby the catalyst bed is expanded to a volume greater than its static volume, wherein the mixture of feedstock, gas and catalyst constitutes a turbulent zone from which aged catalyst is removed and make up catalyst is added, the upper portion of which turbulent zone is defined by a substantially catalyst depleted zone from which hydrocracked product is removed, wherein the improvement comprises:

a. reducing carbon on the catalyst in the bed to 22 wt % or less, based on total carbon-free catalyst
b. setting the flow rate of the first feedstock F1 at a first flow rate F1(1),
c. initiating flow of said second feedstock F2 at a first flow rate F2(1) thereby causing a transient increase in sediment concentration in the hydrocracked product, said first flow rate F2(1) being not more than 5 vol % of the sum of flow rate F1(1) and flow rate F2(1) and maintaining flow rate F2(1) until the sediment concentration decreases to a selected concentration,
d. increasing the flow rate of the second feedstock F2 in increments to cause transient increases in the sediment concentration followed by decreases in the sediment concentration to the selected concentration, and until a selected steady state flow rate F2(SS) is reached, then e. reducing the flow rate of the first feedstock to a value of about zero.

2. The process of claim 1 wherein step d, the increments are each in an amount not more than 5 vol % of the sum of the flow rate of first feedstock F1 and the flow rate of second feedstock F2.

3. The process of claim 1 wherein reducing carbon on catalyst in step a. is accomplished by replacing carbon free make up catalyst to the bed with regenerated make up catalyst.

4. The process of claim 1 wherein reducing carbon on catalyst in step a. is accomplished by adjusting said catalytic reaction temperature and pressure to reduce conversion of said feedstock to hydrocracked product thereby reducing the production of carbon from said feedstock.

5. In a process for changing feedstock from a first, sediment yielding feedstock to a second feedstock of different sediment yield in a continuous process for treating a fluid hydrocarbon feedstock with hydrocarbon-containing gas at elevated catalytic reaction temperature and pressure in the presence of a bed of particulate solid catalyst, said catalyst comprising an amount of carbon thereon, said process comprising introducing the hydrogen-containing gas and feedstock into the lower end of a generally vertical catalyst containing reaction vessel wherein the catalyst is placed in random motion within the fluid hydrocarbon whereby the catalyst bed is expanded to a volume greater than its static volume, wherein the mixture of feedstock, gas and catalyst constitutes a turbulent zone from which aged catalyst is removed and make up catalyst is added, the upper portion of which turbulent zone is defined by a substantially catalyst depleted zone from which hydrocracked product is removed, wherein the improvement comprises:

a. reducing carbon on catalyst in the bed to 22 wt % or less, based on total carbon-free catalyst b. setting the flow rate of the first feedback F1 at a first flow rate F1(1), c. initiating flow of said second feedstock F2 at a first flow rate F2(1) thereby causing a transient increase in sediment concentration in the hydrocracked product, said first flow rate F2(1) being not more than 5 vol % of the sum of flow rate F1(1) and flow rate F2(1) and maintaining flow rate F2(1) until the sediment concentration decreases to a selected concentration, (d) increasing the flow rate of the second feedstock F2 in increments to cause transient increases in the sediment concentration followed by decreases in the sediment concentration to the selected concentration, and until substantially no transient increase in sediment occurs, then e. reducing the flow rate of the first feedstock F1.

6. The process of claim 5 wherein step d. the increments are each in an amount not more than 5 vol % of the sum of the flow rate of first feedstock F1 and the flow rate of second feedstock F2.

7. The process of claim 5 wherein reducing carbon on catalyst in step a. is accomplished by suspending addition of carbon free make up catalyst to the bed and adding regenerated make up catalyst to the bed.

8. The process of claim 5 wherein reducing carbon on catalyst in step a. is accomplished by adjusting said catalytic reaction temperature and pressure to reduce conversion of said feedstock to hydrocracked product thereby reducing the production of carbon from said feedstock.

* * * * *

UNITED STATES PATENT AND TRADEMARK OFFICE

CERTIFICATE OF CORRECTION

PATENT NO. : 5,156,733

DATED : October 20, 1992

INVENTOR(S) : Govanon (NMN) Nongbri, Gerald Verdell Nelson and Stanley Marshall Farabee It is certified that error appears in the above-identified patent and that said Letters Patent is hereby corrected as shown below:

Col. 9,
Claim 5, lines 4-5, please substitute --a hydrogen-containing-- for "hydrocarbon-containing".

Col. 10,
Claim 5, line 23, please substitute --feedstock-- for "feedback".

Col. 10,
Claim 5, line 15, "(d)" should read --d--.

Signed and Sealed this

Fifth Day of October, 1993

Bruce Lehman

*Attest:*

BRUCE LEHMAN

*Attesting Officer*

*Commissioner of Patents and Trademarks*